US005504942A

United States Patent [19]

Kuwahara

[11] Patent Number: 5,504,942

[45] Date of Patent: Apr. 9, 1996

[54] GLOVE CONTAINING AN IMPROVED FINGER PORTION

[75] Inventor: Ichiro Kuwahara, Johnstown, N.Y.

[73] Assignee: Swany America Corporation, Gloversville, N.Y.

[21] Appl. No.: 176,076

[22] Filed: Dec. 30, 1993

[51] Int. Cl.[6] ..... A41D 19/02

[52] U.S. Cl. ..... 2/163; 2/161.6; 2/169

[58] Field of Search ..... 2/158, 159, 160, 2/161.6, 163, 169

[56] References Cited

U.S. PATENT DOCUMENTS

| | | | |
|---|---|---|---|
| Re. 16,609 | 5/1927 | Sturm . | |
| 380,079 | 3/1888 | Biggin . | |
| 1,540,718 | 6/1925 | Strurm | 2/163 |
| 1,542,199 | 6/1925 | White . | |
| 1,598,671 | 9/1926 | Beebe . | |
| 1,620,643 | 3/1927 | Gillian . | |
| 1,666,023 | 4/1928 | Sturm . | |
| 2,728,082 | 12/1955 | Shimovitz | 2/169 |
| 4,131,952 | 1/1979 | Brenning, Jr. | 2/163 |
| 4,507,807 | 4/1985 | Karkanen | 2/163 |
| 4,654,896 | 4/1987 | Rinehart | 2/169 |
| 4,831,667 | 5/1989 | Town | 2/163 |
| 5,167,038 | 12/1992 | Rinehart | 2/164 |

*Primary Examiner*—C. D. Crowder
*Assistant Examiner*—Larry D. Worrell, Jr.
*Attorney, Agent, or Firm*—Wenderoth, Lind & Ponack

[57] ABSTRACT

A back finger portion of a glove is provided which is composed of (a) a modified star pattern piece having four radiating projections, the radiating projections forming a first portion of four back finger parts, the star pattern piece having an inner cutout with a junction edge, and (b) four back finger pattern pieces joined to the four radiating projections respectively, the back finger pattern pieces forming a second portion of the four back finger parts respectively. A glove is provided which incorporates the back finger portion and a conventional palm pattern piece, preferably a flat single palm piece. A method of making the back finger portion and the glove are also provided. The back finger portion and glove produced therefrom is advantageous over gloves produced using one or two conventional four-pointed star patterns, in generating less waste material, in having better stretchability, in having an inherent curvature in the fingers corresponding to the natural curvature of the fingers of a hand, and in allowing the finger tips of the glove to be made from a different material.

14 Claims, 6 Drawing Sheets

GLOVE CONTAINING AN IMPROVED FINGER PORTION

BACKGROUND OF THE INVENTION

1. Field of the Invention

This invention relates to gloves, particularly to the construction of the finger portion of a glove.

2. Description of the Related Prior Art

The prior art is characterized by a wide variety of glove constructions, particularly with respect to the finger portion of a glove. For purposes of this specification, the finger portion of a glove is defined as that portion of a glove which covers the index, middle, ring and little fingers of a hand. The back and front finger portions of a glove are consequently defined as those parts of the finger portion which cover the backs and fronts of these four fingers, respectively. A finger part is defined as that portion of a front or back finger portion that covers the front or back of an individual finger, respectively.

One relatively old construction for a glove finger portion is exemplified by U.S. Pat. No. 1,666,023 and U.S. Pat. No. Re. 16,609. These patents teach a glove construction for the finger portion of a glove which is based upon a four-pointed star-shaped pattern having an inner cutout. Each of the four points of this pattern form the four finger backs of a glove. The inner cutout permits the pattern to be spread out and form concave openings capable of covering the backs and sides of fingers. To complete the glove back, the star pattern is joined to a substantially rectangular back hand pattern piece. To complete the glove, the glove back is joined to a flat single palm piece corresponding to the size and shape of the wearer's fingers and palm.

More recent glove constructions have utilized two superimposed four-pointed star-shaped patterns to form the finger portion of a glove. These constructions are exemplified in U.S. Pat. Nos. 4,654,896, 4,831,667 5,167,038 for example. In these gloves, the four points of each superimposed star-shaped pattern piece form the front and back finger parts of the finger portion of the gloves.

One problem with the foregoing glove constructions using either one or two conventional four-pointed star-shaped patterns is the amount of waste material which is generated when cutting the star pattern. Because the four points of the star pattern must have a length corresponding to the length of a wearer's fingers, and because the four points extend radially outwardly from the center of the star pattern, a large amount of material can be consumed when cutting each star pattern.

Another problem is the absence of any inherent curvature in the fingers of a glove containing either a single or two superimposed star patterns. It is advantageous that a glove be constructed so as to have a slight inherent curvature in the finger portion corresponding to the natural curvature of the fingers of a hand in a relaxed state. The glove construction of U.S. Pat. No. 4,654,896 provides a tucked or lapped portion of material on the finger backs of the glove near the wearer's knuckles. This tucked portion provides some added flexibility and may provide some small curvature to the fingers of the glove, but the tucked portion adds to the manufacturing process and has other disadvantages discussed in U.S. Pat. No. 5,167,038. No other glove construction using a four-pointed star-shaped pattern is known to provide an inherent curvature in the finger portion.

A further problem with the foregoing constructions is a limited degree of flexibility and stretchability of the finger portions of the gloves.

Regarding a glove constructed of two superimposed star patterns, a still further problem is chafing to the wearer's palm caused by the seam which joins the star pattern piece covering the front or palm side of the fingers to the palm piece.

A principal object of the present invention is to provide a glove construction having a back finger portion which conserves material when compared with the amount of material used in a glove containing a conventional four-pointed star-shaped pattern.

Another principal object of the present invention is to provide a simple glove construction having an inherent degree of curvature in the finger portion of the glove corresponding to the natural curvature of the fingers of a hand in a relaxed state.

A further object of the invention is to provide a glove construction having an increased degree of flexibility and stretchability when compared with a glove containing a conventional star pattern.

A still further object of the invention is to provide a glove which does not have a seam on the palm of the hand to cause chafing.

SUMMARY OF THE INVENTION

The present invention provides a glove construction in which the back finger portion of the glove is a modified star pattern piece in which the finger parts are composed of more than one section, preferably two sections joined at about the medial or middle knuckle of each finger.

More specifically, the back finger portion is composed of (a) a star pattern piece having four radiating projections, the radiating projections forming a first portion of four back finger parts, the star pattern piece having an inner cutout with a junction edge, and (b) four back finger pattern pieces joined to the four radiating projections respectively, the back finger pattern pieces forming a second portion of the four back finger parts respectively.

In a preferred embodiment, the back finger pattern pieces have a straight peripheral edge at a base portion and a convexly curved peripheral edge at a tip portion, the radiating projections of the star pattern piece have a convexly curved peripheral edge, and the straight peripheral edges of the back finger pattern pieces are joined to the convexly curved peripheral edges of the star pattern piece, respectively, to obtain the back finger portion of a glove according to this invention.

A glove according to the present invention is generally constructed by joining the above-described back finger portion at its first junction edge of the first inner cutout with a conventional substantially rectangular back hand pattern piece. A palm pattern piece is joined to the back finger portion and back hand portion at their outer peripheries. The palm pattern piece comprises (a) a palm portion and (b) four front finger parts, the palm portion having a second inner cutout with a second junction edge. The palm pattern piece is preferably a single flat piece of material. In addition, a conventional thumb pattern piece is joined to the palm portion of the palm pattern piece at the second junction edge of the second inner cutout. The method of making the back finger portion and glove of this invention is not limited to any sequential order of assembly steps. The individual pattern pieces may be assembled in any sequential order so long as the present glove construction is achieved.

As a result of the above-described construction, the glove of this invention has an inherent curvature in the fingers corresponding to the natural curvature of the wearer's fingers.

In addition, the glove of this invention consumes less material in its construction than known gloves utilizing a single or two superimposed conventional four-pointed star-shaped patterns.

Moreover, the glove of this invention has greater flexibility and stretchability because of the construction of the back finger portion.

Furthermore, the back finger pattern pieces may be composed of a different material than the star pattern piece and/or other pattern pieces. This enables the glove to be adapted for special uses. For example, the back finger pattern pieces may be composed of a stronger material than the remainder of the glove to provide greater wear and finger protection to a wearer during use in a sport such as snowboarding.

Still further, the glove of this invention does not have a seam on the palm side of the glove to cause chafing as does a glove constructed from two superimposed star patterns.

In summary, the back finger portion of a glove according to the present invention, and the glove produced therefrom, have several significant differences and advantages which are not provided or suggested by known glove constructions. The invention will now be described with reference to the attached figures, of which the following is a brief description.

DETAILED DESCRIPTION OF THE PREFERRED EMBODIMENT(S)

Figure 1:
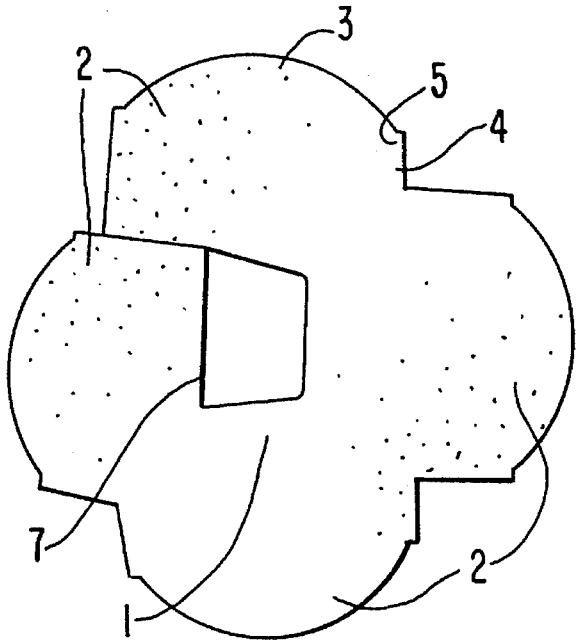
FIG. 1 is a plan view of a star pattern piece used in the construction of a back finger portion of a glove according to one embodiment of the present invention.

Referring to FIG. 1, there is illustrated the first component part of the back finger portion of a glove according to the present invention, i.e. a star pattern piece 1 having four radiating projections 2.

The radiating projections 2 form a first portion of four back finger parts of the glove. The radiating projections preferably have a convexly curved peripheral edge 3 as shown in FIG. 1.

Figure 2:
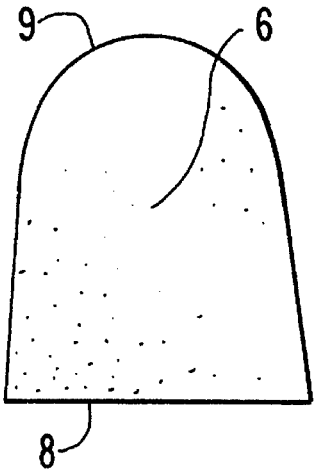
FIG. 2 is a plan view of a back finger pattern piece used in the construction of the index, middle and ring finger parts of the glove.
Figure 3:
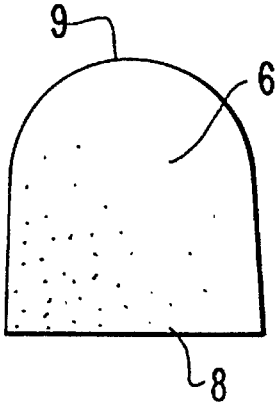
FIG. 3 is a plan view of a back finger pattern piece used in the construction of a little finger part of the glove.

At the intersection of the radiating projections 2 and the lateral sides 4 of the finger parts, there is preferably provided a small piece of material 5 which ensures a secure joint between the radiating projections 2 and the back finger pattern pieces 6 shown in FIGS. 2 and 3.

The star pattern 1 also has a first inner cutout 7 with a first junction edge 8 located near the center of the star pattern 1. The first inner cutout 7 is quadrilateral, preferably substantially rectangular or trapezoidal as shown in FIG. 1.

Referring to FIGS. 2 and 3, the second component part of the back finger portion of the present glove is illustrated. Namely, in addition to the above-described star pattern piece 1 component, the back finger portion of the present glove is composed of four back finger pattern pieces 6 which are joined to said four radiating projections 1, respectively. The back finger pattern pieces 6 form a second portion of the four back finger parts respectively.

As shown in FIGS. 2 and 3, the back finger pattern pieces 6 preferably have a straight peripheral edge 8 at a base portion and a convexly curved peripheral edge 9 at a tip portion.

The four back finger pattern pieces 6 may have any length necessary to accomodate different size fingers. Preferably, some of the back finger pattern pieces 6 may have the same length. More preferably, the back finger pattern piece 6 for the index, middle and ring finger parts of the glove have the same length. FIG. 2 shows an example of a back finger pattern piece 6 which can be used for the index, middle and ring back finger parts of the glove. FIG. 3 shows an example of a back finger pattern piece 6 which is shorter in length than that shown in FIG. 2 and which can be used for the little back finger part of the glove.

The lengths of the radiating projections and respective back finger pattern pieces may be varied, provided that the total overall length of the two joined component parts is sufficient in length to accomodate the respective fingers of the wearer when the finger parts of the glove are joined. It is preferable that the lengths of the radiating projections and respective back finger pattern pieces be set so that the joint is disposed at a location at or near the medial knuckle of each respective finger. The medial knuckle of a finger is defined as the knuckle joint which is disposed between the two longest phalanges or bones in each finger, there being generally understood to be three phalanges and three knuckle joints in each finger. Alternatively, the joint may be disposed in other locations along the length of each finger part. It is contemplated that the back finger parts of the glove may even be composed of more than a single back finger pattern piece per finger. However a single back finger pattern piece per back finger part is preferred.

Regarding the relative lengths of the back finger pattern pieces and the radiating projections, the radiating projections of the star pattern piece may have a length in a ratio of about 1:1 to 1:2 with respect to the length of the four back finger pattern pieces, respectively. For example, the lengths of the radiating projections shown in the embodiment in FIG. 1 for the index, middle, ring and little finger parts are about 1.3 inches, 2 inches, 1.75 inches and 1.5 inches, respectively. The lengths of the back finger pattern pieces shown in FIG. 2 for the index, middle, and ring back finger parts is about 2.8 inches, whereas the length of the back finger pattern piece shown in FIG. 3 for the little back finger part is about 2.15 inches.

Similarly, the four back finger pattern pieces 6 may have any width necessary to accomodate different size fingers. Preferably, some of the back finger pattern pieces 6 may have the same width. More preferably, the back finger pattern piece 6 for the index, middle and ring finger parts of the glove have the same width. FIG. 2 shows an example of a back finger pattern piece 6 which can be used for the index, middle and ring back finger parts of the glove having the same width. In this embodiment, the width is about 2.5 inches. FIG. 3 shows an example of a back finger pattern piece 6 which is narrower in width than that shown in FIG. 2, and which can be used for the little back finger part of the glove. In this embodiment, the width is about 2 inches.

Figure 4:
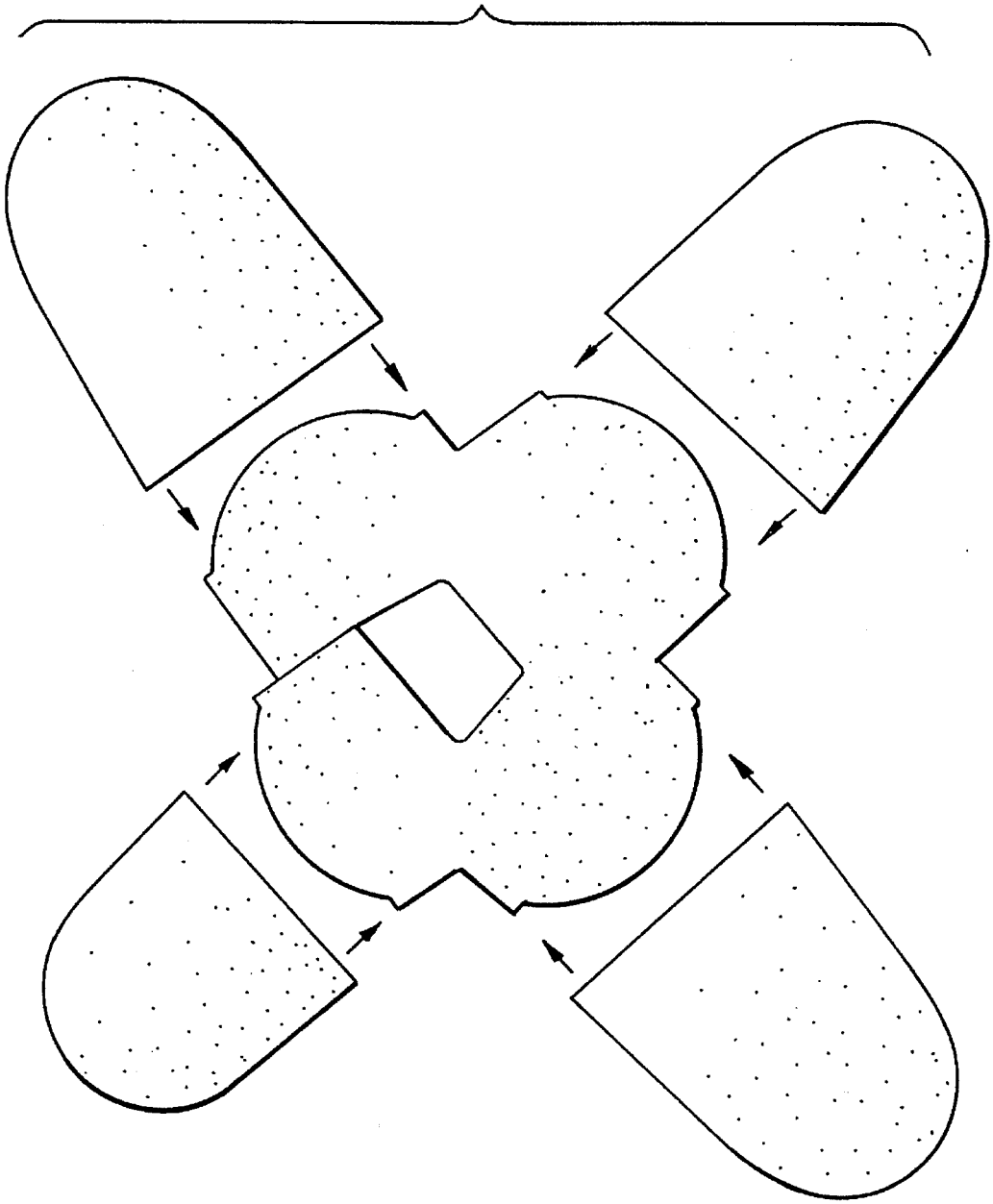
FIG. 4 is a schematic view of the method for making a back finger portion of the glove according to the present invention.

To construct the back finger portion of the glove according to the present invention, the back finger pattern pieces are joined to the radiating projections for each finger part. In the preferred glove embodiment, the back finger pattern pieces have a straight peripheral edge at a base portion and a convexly curved peripheral edge at a tip portion, the radiating projections of the star pattern piece have a convexly curved peripheral edge, and the straight peripheral edges of the back finger pattern pieces are joined to the convexly curved peripheral edges of the star pattern piece respectively. FIG. 4 is a schematic view showing the method for making a back finger portion of a glove according to the preferred invention.

The back finger pattern pieces and star pattern piece are joined together by any conventional means such as stitching, gluing or other sealing means. It is preferable that the pieces be joined by stitching. It is also preferable that back finger pattern pieces be joined by stitching which is disposed on the exterior surface of the glove, so that the seams will not irritate the fingers disposed when they are within the finger parts of the glove. Surprisingly, when the back finger pattern pieces are joined to the radiating projections in this manner by stitching on the exterior surface of the glove, the wearer cannot feel the seams.

The glove of this invention is suitable for constructing "in the flat", i.e. using a flatbed-type sewing machine or a flat hot press to join the seams by stitching or glue, respectively.

As in most conventional four-pointed star-shaped patterns, the first junction edge of the first inner cutout is in a non-linear geometrical configuration when the star pattern piece is in a flat state prior to assembly into a glove. In addition, the first junction edge of the first inner cutout is in a linear geometrical configuration when the star pattern piece is in a convexly curved state for covering the fingers with each respective finger part when the star pattern piece has been assembled into a glove.

The back finger pattern pieces may be composed of a material which is the same or different than the star pattern piece and/or other pieces of the glove. The use of different materials enables the glove to be adapted for special uses. For example, the back finger pattern pieces may be composed of a stronger material than the star pattern and/or the remainder of the glove to provide greater wear and finger protection to a wearer during use in a sport such as snowboarding. Leather is the preferred construction material but any conventional material may be used depending upon the intended glove use.

Figure 5:
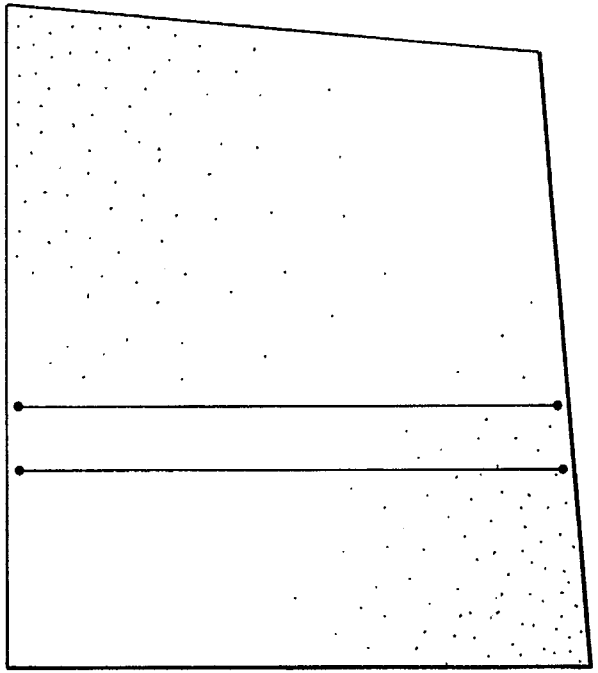
FIG. 5 is a plan view of a back hand pattern piece used in the construction of the glove according to the present invention.

To construct a glove according to the present invention, the above-described back finger portion is joined to a back hand pattern piece such as the substantially rectangular piece shown in FIG. 5. More specifically, the first junction edge of the first inner cutout of the star pattern is spread out in a linear configuration and joined to an edge of the back hand pattern piece.

Figure 6:
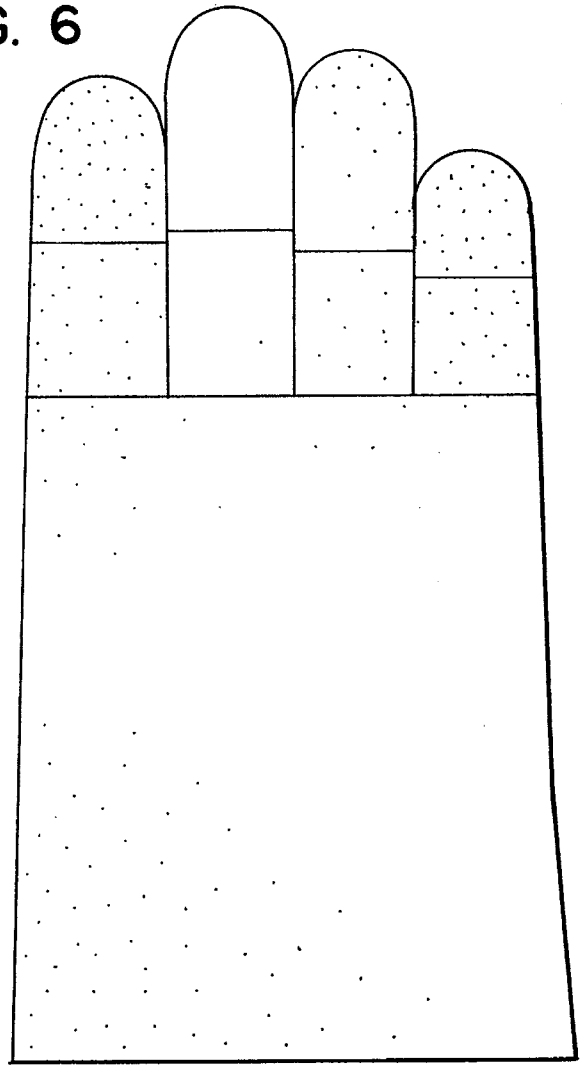
FIG. 6 is a plan view of the glove according to the present invention showing a back finger portion joined to a back hand pattern piece.

FIG. 6 is a plan view of a glove according to the present invention showing a back finger portion joined to a back hand pattern piece.

Figure 7:
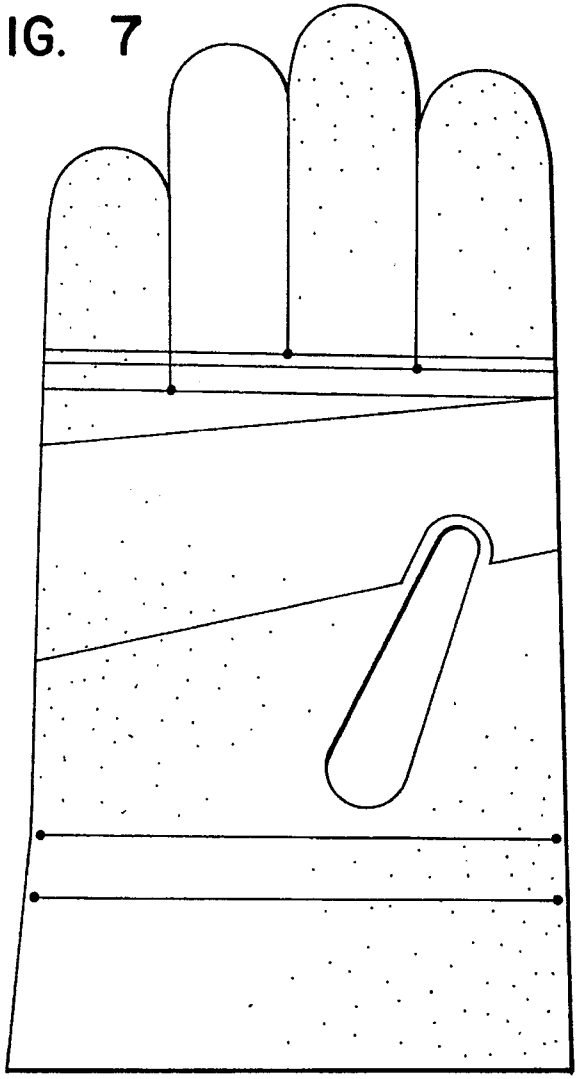
FIG. 7 is a plan view of a palm portion used in the construction of the glove according to the present invention.

Referring to FIG. 7, a palm pattern piece is shown comprising (a) a palm portion and (b) four front finger parts. The palm portion has a second inner cutout with a second junction edge. A thumb pattern piece is joined to the palm portion at the second junction edge of the second inner cutout.

The back finger portion, back hand pattern piece and palm pattern piece are joined together at their outer peripheries, preferably by stitching which is disposed on the exterior surface of the glove.

The radiating projections of the star pattern piece and the four back finger pattern pieces forming the finger parts of the glove back have a width which is greater than the width of the four front finger parts of the palm pattern piece.

Figure 8:
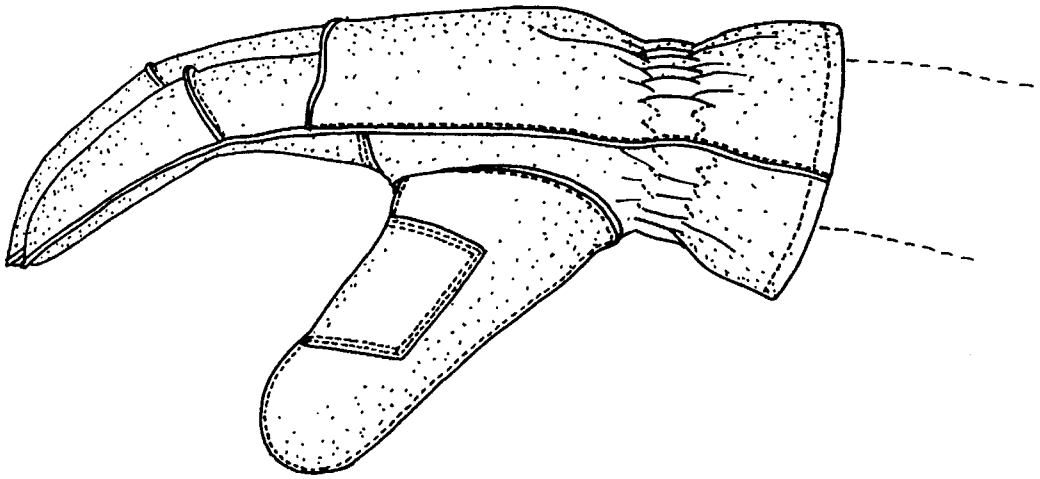
FIG. 8 is a side view of a finger part of the glove constructed according to a preferred embodiment of the present invention showing the inherent curvature of the finger part resulting from the glove construction and showing the first and second finger portions which are joined at the knuckle.

FIG. 8 is a side view of a finger part of a glove constructed according to the present invention showing the inherent curvature of the finger part resulting from the glove construction.

Figure 9A:
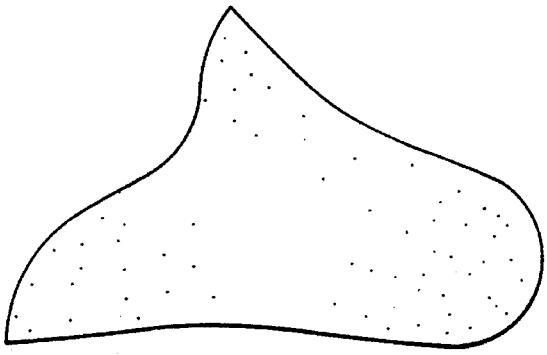
FIGS. 9(*a*) and (*b*) are plan views of a thumb pattern piece composed of two separate pieces.
Figure 9B:
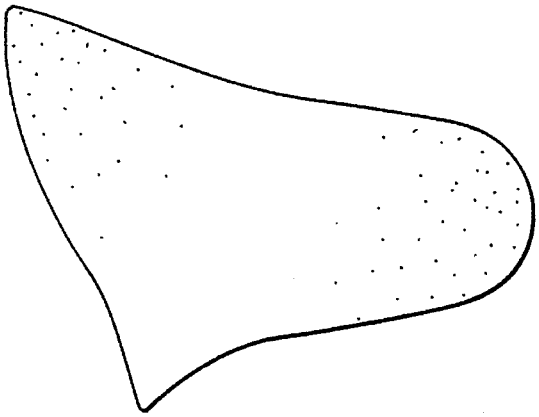

FIG. 9 is a plan view of a conventional thumb pattern piece composed of two separate pieces. Alternatively, the thumb pattern piece may be composed of a single piece or any conventional configuration.

Figure 10:
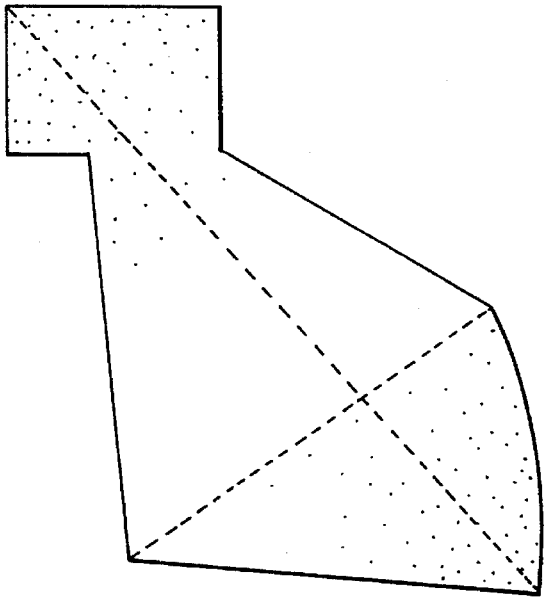
FIG. 10 is a plan view of a palm reinforcement pattern piece.

FIG. 10 is a plan view of a palm reinforcement pattern piece. This piece may be optionally provided in the glove and have any suitable shape. It is joined to the exterior surface of the palm portion of the glove. The palm reinforcement pattern piece provides an additional measure of thickness and protection to the wearer's palm as well as providing additional wear resistance.

Figure 11:
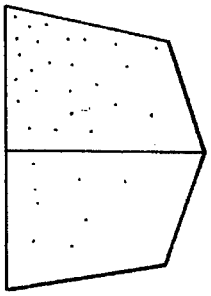
FIG. 11 is a plan view of a thumb reinforcement pattern piece.

FIG. 11 is a plan view of a thumb reinforcement pattern piece. Like the palm reinforcement piece, the thumb reinforcement piece may be optionally provided in any suitable shape. It is joined to the exterior surface of the thumb portion of the glove, for example the portion which opposes the palm and fingers, to provide an additional measure of thickness and protection to the wearer's thumb as well as to provide additional wear resistance.

Figure 12:
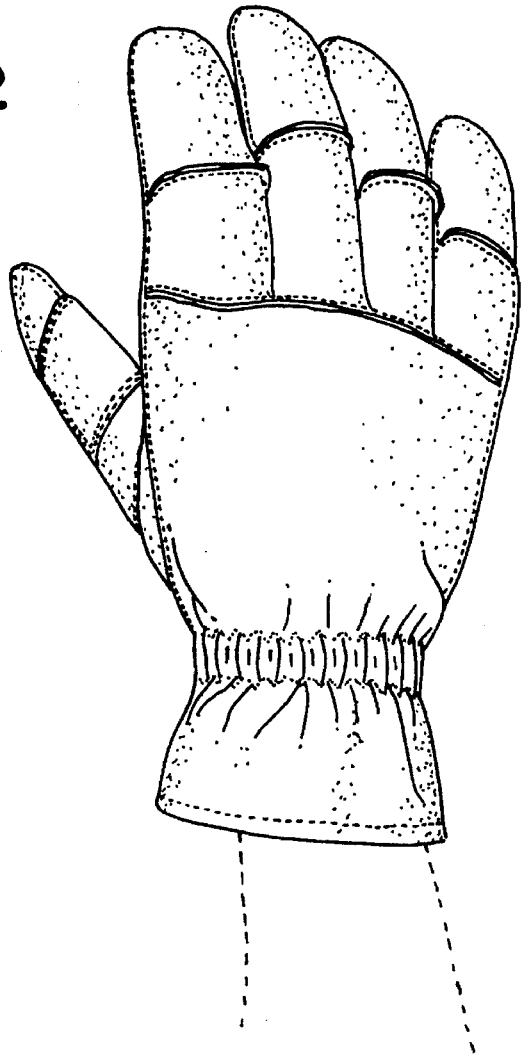
FIG. 12 is a perspective view of a glove according to this invention taken from back side.
Figure 13:
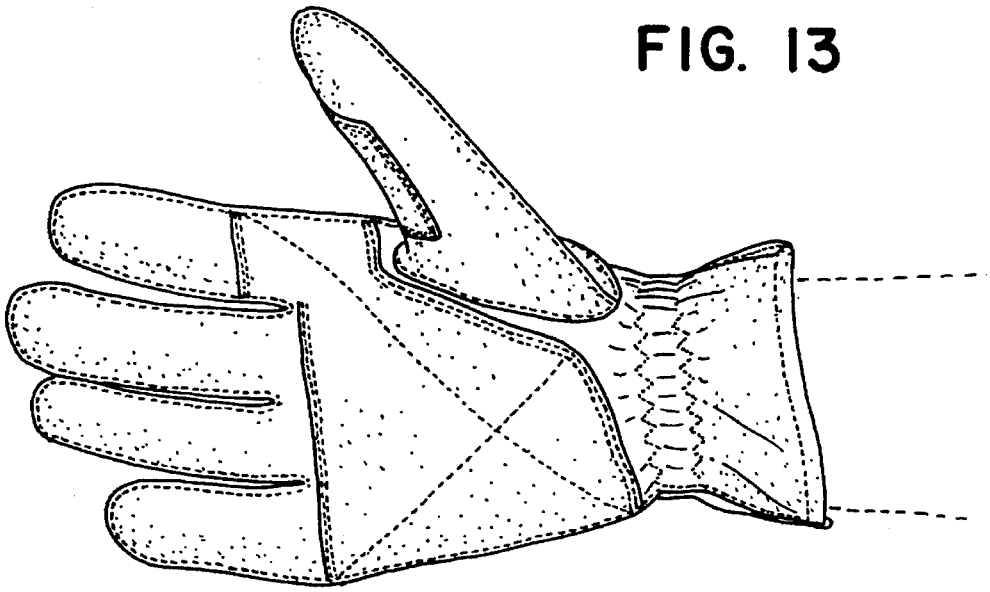
FIG. 13 is a perspective view of a glove according to this invention taken from the palm side.

FIG. 12 is a back side perspective view showing a glove constructed according to the present invention, and FIG. 13 is a palm side view thereof.

The method of making a back finger portion of a glove according to the invention generally comprises the steps of:

cutting a star pattern piece having four radiating projections, the radiating projections forming a first portion of four back finger parts, the star pattern piece having an inner cutout with a junction edge, cutting four back finger pattern pieces forming a second portion of said four back finger parts respectively, and joining the four radiating projections to the four back finger pattern pieces, respectively.

As mentioned above, it is preferable that the back finger pattern pieces have a straight peripheral edge at a base portion and a convexly curved peripheral edge at a tip portion, the radiating projections of the star pattern piece have a convexly curved peripheral edge, and the straight peripheral edges of the back finger pattern pieces are joined to the convexly curved peripheral edges of the star pattern piece respectively.

The method of making a glove according to the invention generally comprising the steps of:

cutting a star pattern piece having four radiating projections, the radiating projections forming a first portion of four back finger parts, the star pattern piece having a first inner cutout with a first junction edge, cutting four back finger pattern pieces forming a second portion of the four back finger parts respectively, cutting a back hand pattern piece, cutting a palm pattern piece comprising (a) a palm portion and (b) four front finger parts, the palm portion having a second inner cutout with a second junction edge, cutting a thumb pattern piece, joining the four radiating projections of the star pattern piece to the four back finger pattern pieces, respectively, to form a back finger portion of the glove, joining the back hand pattern piece to the first junction edge of the first inner cutout, joining the back finger portion, the back hand pattern piece and the palm pattern piece at their outer peripheries, and joining the thumb pattern piece to the palm portion at the second junction edge of the second inner cutout to obtain the glove.

It will be apparent to one skilled in the art that the steps of the foregoing methods may be performed in different sequential orders than recited above.

In conclusion, the foregoing description of the present invention is presented for illustrative purposes, not by way of limitation, and the inventor intends that the scope of the appended claims cover all other equivalent embodiments of the invention which would be recognized by those skilled in the art.

I claim:

1. A back finger portion of a glove comprising:

(a) a star pattern piece having four radiating projections, said radiating projections forming a first portion of four back finger parts, said star pattern piece having a first inner cutout with a first junction edge, and (b) four back finger pattern pieces joined to said four radiating projections respectively, said back finger pattern pieces forming a second portion of said four back finger parts respectively, wherein said back finger pattern pieces have a straight peripheral edge at a base portion and a convexly curved peripheral edge at a tip portion, wherein said radiating projections of said star pattern piece have a convexly curved peripheral edge, and wherein said straight peripheral edges of said back finger pattern pieces are joined to said convexly curved peripheral edges of said star pattern piece respectively.

2. The back finger portion of a glove according to claim 1, wherein said back finger pattern pieces and said star pattern piece are joined together by stitching which is disposed on an exterior surface of the glove.

3. The back finger portion of a glove according to claim 1, wherein said first inner cutout is quadrilateral.

4. The back finger portion of a glove according to claim 1, wherein said first inner cutout is rectangular or trapezoidal.

5. The back finger portion of a glove according to claim 1, wherein said back finger pattern pieces are composed of a material which is different than said star pattern piece.

6. The back finger portion of a glove according to claim 1, wherein said first and second portions of said four back finger parts are joined at a location corresponding to the medial knuckles of the wearer's fingers.

7. A glove, comprising:

a back finger portion comprising (a) a star pattern piece having four radiating projections, said radiating projections forming a first portion of four back finger parts, said star pattern piece having a first inner cutout with a first junction edge, and (b) four back finger pattern pieces joined to said four radiating projections respectively, said back finger pattern pieces forming a second portion of said four back finger parts respectively, a back hand pattern piece which is joined to said first junction edge of said first inner cutout, a palm pattern piece comprising (a) a palm portion and (b) four front finger parts, said palm portion having a second inner cutout with a second junction edge, a thumb pattern piece joined to said palm portion at said second junction edge of said second inner cutout, wherein said back finger portion, said back hand pattern piece and said palm pattern piece are joined together at their outer peripheries.

8. The glove according to claim 7, wherein said back finger pattern pieces have a straight peripheral edge at a base portion and a convexly curved peripheral edge at a tip portion, wherein said radiating projections of said star pattern piece have a convexly curved peripheral edge, and wherein said straight peripheral edges of said back finger pattern pieces are joined to said convexly curved peripheral edges of said star pattern piece respectively.

9. The glove according to claim 7, wherein said back finger pattern pieces and said star pattern piece are joined together by stitching which is disposed on an exterior surface of the glove, and wherein said back finger portion, said back hand pattern piece and said palm pattern piece are joined together at their outer peripheries by stitching disposed on an exterior surface of the glove.

10. The glove according to claim 7, wherein said first inner cutout is rectangular or trapezoidal.

11. The glove according to claim 7, wherein said back finger pattern pieces are composed of a material which is different than said star pattern piece.

12. The glove according to claim 7, wherein said radiating projections and said four back finger pattern pieces have a width which is greater than the width of said four front finger parts.

13. A method of making a back finger portion of a glove, comprising the steps of:

cutting a star pattern piece having four radiating projections, the radiating projections forming a first portion of four back finger parts, the star pattern piece having an inner cutout with a junction edge, cutting four back finger pattern pieces forming a second portion of said four back finger parts respectively, wherein said back finger pattern pieces have a straight peripheral edge at a base portion and a convexly curved peripheral edge at a tip portion, wherein said radiating projections of said star pattern piece have a convexly curved peripheral edge, and wherein said straight peripheral edges of said back finger pattern pieces are joined to said convexly curved peripheral edges of said star pattern piece respective, and joining the four radiating projections to the four back finger pattern pieces, respectively.

14. A method of making a glove, comprising the steps of:

cutting a star pattern piece having four radiating projections, the radiating projections forming a first portion of four back finger parts, the star pattern piece having a first inner cutout with a first junction edge, cutting four back finger pattern pieces forming a second portion of the four back finger parts respectively, cutting a back hand pattern piece, cutting a palm pattern piece comprising (a) a palm portion and (b) four front finger parts, the palm portion having a second inner cutout with a second junction edge, cutting a thumb pattern piece, joining the four radiating projections of the star pattern piece to the four back finger pattern pieces, respectively, to form a back finger portion of the glove, joining the back hand pattern piece to the first junction edge of the first inner cutout, joining the back finger portion, the back hand pattern piece and the palm pattern piece at their outer peripheries, and joining the thumb pattern piece to the palm portion at the second junction edge of the second inner cutout to obtain the glove.

* * * * *